US007902944B2

(12) United States Patent
Fukunaga

(10) Patent No.: US 7,902,944 B2
(45) Date of Patent: Mar. 8, 2011

(54) STACKED RESONATOR

(75) Inventor: Tatsuya Fukunaga, Tokyo (JP)

(73) Assignee: TDK Corporation, Tokyo (JP)

( * ) Notice: Subject to any disclaimer, the term of this patent is extended or adjusted under 35 U.S.C. 154(b) by 1080 days.

(21) Appl. No.: 11/656,540

(22) Filed: Jan. 23, 2007

(65) Prior Publication Data

US 2007/0171005 A1 Jul. 26, 2007

(30) Foreign Application Priority Data

Jan. 26, 2006 (JP) ..... 2006-017252

(51) Int. Cl.
*H01P 1/205* (2006.01)
*H01P 7/08* (2006.01)

(52) U.S. Cl. ..... 333/203; 333/204; 333/219

(58) Field of Classification Search ..... 333/4, 5, 333/25, 26, 156, 32, 33, 35, 128, 204, 202, 333/219, 203

See application file for complete search history.

(56) References Cited

U.S. PATENT DOCUMENTS

| | | | | |
|---|---|---|---|---|
| 4,418,324 | A * | 11/1983 | Higgins | 333/204 |
| 6,690,251 | B2 * | 2/2004 | Toncich | 333/202 |
| 7,652,548 | B2 * | 1/2010 | Yoshikawa et al. | 333/204 |

FOREIGN PATENT DOCUMENTS

| | | | |
|---|---|---|---|
| JP | A-9-148870 | | 6/1997 |
| JP | A 2003-218604 | | 7/2003 |
| WO | WO2005/011046 | * | 7/2004 |

* cited by examiner

*Primary Examiner* — Benny Lee
*Assistant Examiner* — Gerald Stevens
(74) *Attorney, Agent, or Firm* — Oliff & Berridge, PLC

(57) ABSTRACT

Provided are a stacked resonator capable of achieving miniaturization and minimum loss, and a stacked resonator capable of suppressing any unnecessary resonance mode due to interdigital-coupling. The stacked resonator includes a first conductor group having a plurality of conductor lines in a stacking arrangement, and a second conductor group having a plurality of other conductor lines in a stacking arrangement so as to be alternately provided opposing to the conductor lines in the first conductor group, thereby establishing an interdigital-coupling together with the first conductor group.

7 Claims, 15 Drawing Sheets

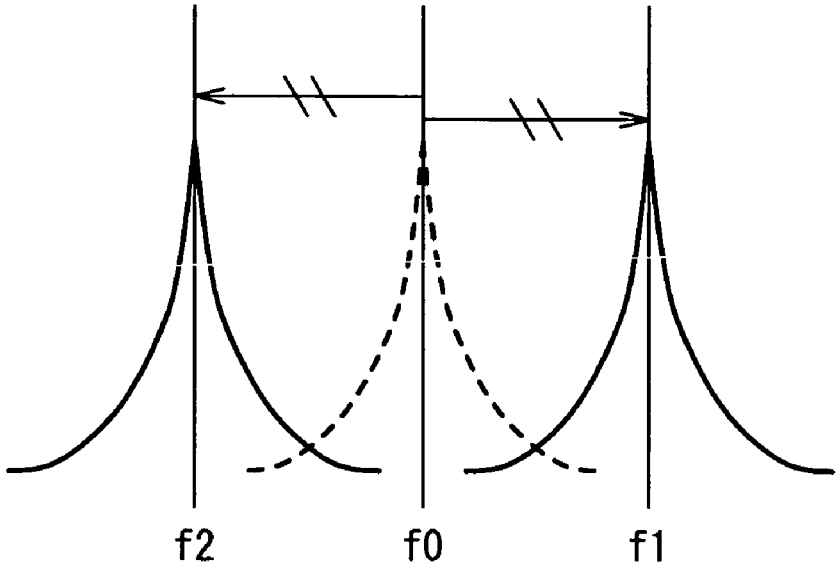
FIG. 7
FIG. 8A
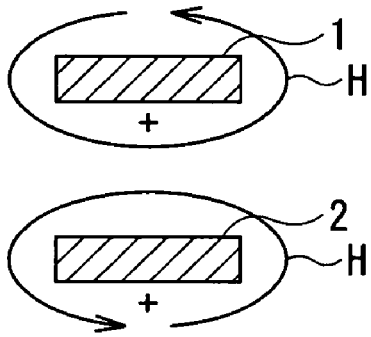
FIG. 8B
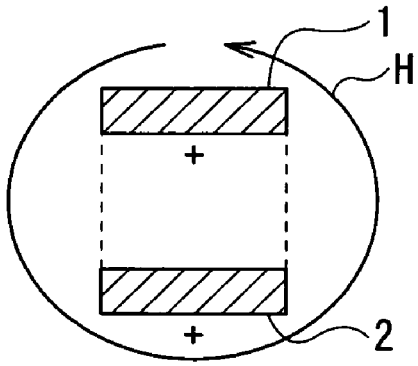

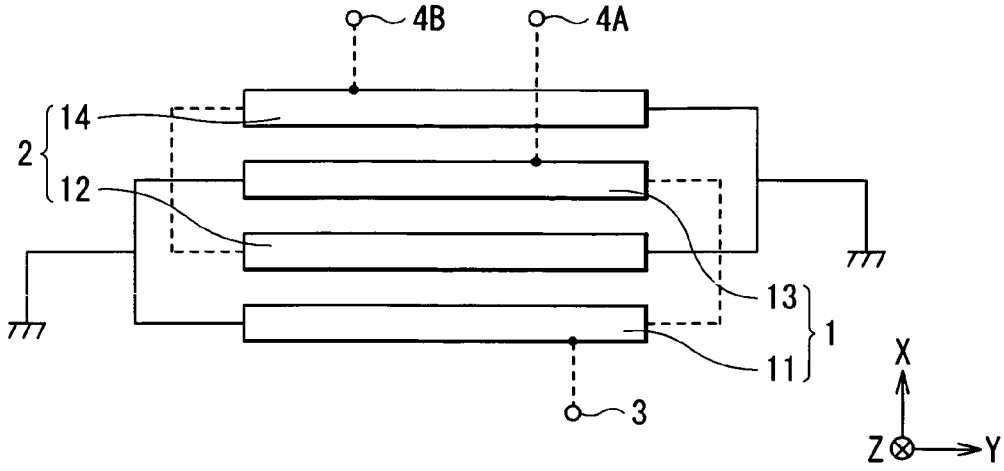
FIG. 12
FIG. 13A
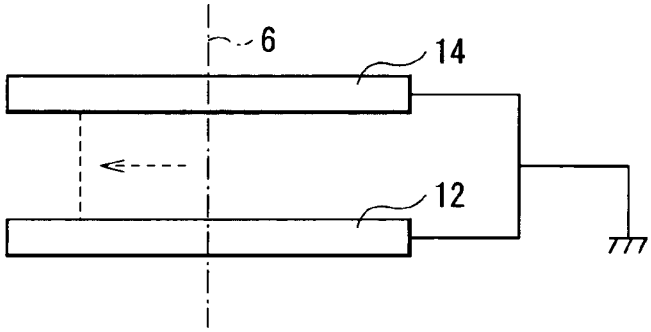
FIG. 13B
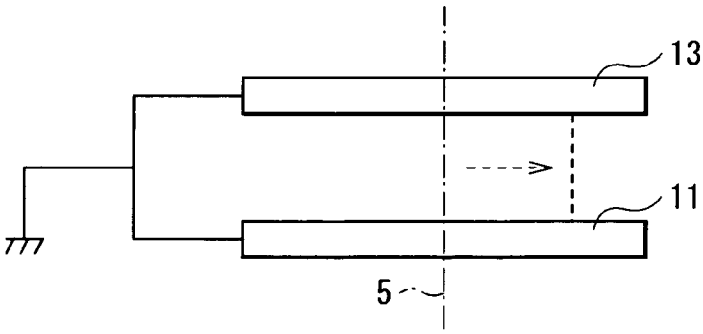

RELATED ART

STACKED RESONATOR

BACKGROUND OF THE INVENTION

1. Field of the Invention

The present invention relates to a stacked resonator with a plurality of conductors stacking one upon another.

2. Description of the Related Art

For example, demanding requirements of miniaturization and minimum loss are placed on filters used in radio communication equipments such as cellular phones. Consequently, the same is true for resonators configuring the filters. Japanese Unexamined Patent Publication No. 2003-218604 describes a stacked dielectric resonator in which a plurality of resonance electrodes are stacked so as to be comb-line coupled to each other.

FIG. 23 illustrates schematically a resonator structure when two quarter-wave (λ/4) resonators each including a TEM (transverse electro magnetic) line are comb-line coupled to each other. The term "comb-line coupling" is a method of coupling two resonators 101 and 102 so as to be electromagnetically coupled to each other by arranging so that their respective open ends 101A and 102A are opposed to each other, and their respective short-circuit ends are opposed to each other. FIGS. 24A and 24B illustrate schematically distributions of magnetic fields H in the two comb-line coupled resonators 101 and 102. Specifically, FIGS. 24A and 24B illustrate magnetic fields within a cross section orthogonal to the direction of flow of a current i in the resonators illustrated in FIG. 23. The direction of the current i in FIGS. 24A and 24B is a direction orthogonal to the drawing surface. In the two comb-line coupled resonators 101 and 102, as illustrated in FIG. 24A, the magnetic field H is distributed in the same direction (for example, in a counterclockwise direction) within the cross section. In this case, when the two resonators 101 and 102 are brought into a close relationship in the stacking direction to establish a strong comb-line coupling, the result is a magnetic field equivalent to the condition which the two resonators 101 and 102 are assumed to be a single conductor, as illustrated in FIG. 24B. This substantially increases conductor thickness. Thus, in the stacked dielectric resonator as described in the above Publication, the conductor thickness can be assumed to be increased to reduce the conductor loss by using the property that the current i flows in the same direction to each of the comb-line coupled resonators.

SUMMARY OF THE INVENTION

In the structure that the resonance electrodes are comb-line coupled and stacked as in the stacked dielectric resonator of the above-mentioned publication, however, the overall dimension of the resonator is limited by the dimension of each resonance electrode determined by an operating frequency (for example, the dimension of a quarter-wave of the operating frequency). That is, the comb-line coupled stacked structure can reduce the loss, but it is difficult to achieve miniaturization because the dimension is limited by the operating frequency.

In view of the foregoing, it is desirable to provide a stacked resonator capable of achieving miniaturization and minimum loss. It is also desirable to provide a stacked resonator capable of suppressing the generation of any unnecessary resonance mode due to interdigital-coupling.

According to an embodiment of the present invention, there is provided a stacked resonator including a first conductor group and a second conductor group. The first conductor group has a plurality of conductor lines in a stacking arrangement, one end of each of the conductor lines being configured as a short-circuit end, and the other end thereof being configured as an open end. The second conductor group has a plurality of other conductor lines in a stacking arrangement so as to be alternately provided opposing to the conductor lines in the first conductor group, such that one end of each of the conductor lines in the second conductor group is opposed to the open ends of the conductor lines in the first conductor group and is configured as a short-circuit end and other end of each of the conductor lines in the second conductor group is opposed to the short ends of the conductor lines in the first conductor group and is configured as an open end, thereby establishing an interdigital-coupling together with the first conductor group.

In the stacked resonator of the embodiment of the present invention, when the first conductor group is regarded in whole as one resonator, and the second group is regarded in whole as other resonator, the result is equivalent to a stacked resonator configured of a pair of interdigital-coupled resonators each using one end thereof as an open end, and the other end thereof as a short-circuit end. When a pair of resonators are of interdigital type and strongly coupled to each other, with respect to a resonance frequency $f_0$ in each of the resonators when establishing no interdigital-coupling (i.e., the resonance frequency determined by the physical length of a quarter-wave), there appear two resonance modes of a first resonance mode that resonates at a first resonance frequency $f_1$ higher than the resonance frequency $f_0$, and a second resonance mode that resonates at a second resonance frequency $f_2$ lower than the resonance frequency $f_0$, and the resonance frequency is then divided into two. In this case, by setting, as an operating frequency as a resonator, the second resonance frequency $f_2$ lower than the resonance frequency $f_0$ corresponding to the physical length, miniaturization can be facilitated than setting the operating frequency to the resonance frequency $f_0$. For example, when a filter is designed by setting 2.4 GHz band as a passing frequency, it is possible to use a quarter-wave resonator whose physical length corresponds to 8 GHz, for example. This is smaller than the quarter-wave resonator whose physical length corresponds to 2.4 GHz band. Further, in the second resonance mode of a lower frequency, a current i flows in the same direction to the individual resonators of each conductor group, and the conductor thickness can be increased substantially thereby to reduce conductor loss.

Alternatively, the conductor lines in the first conductor group may be in conduction to each other at positions other than the short-circuit ends of the conductor lines in the first conductor group, and the conductor lines in the second conductor group may be in conduction to each other at positions other than the short-circuit ends of the conductor lines in the second conductor group.

With this configuration, the respective conductor lines in the first and second conductor groups are in conduction to each other at the positions other than the short-circuit ends of the conductor lines. This suppresses any unnecessary resonance mode (a higher resonance mode having a high frequency than the second resonance mode) due to interdigital coupling.

Preferably, the positions where the conductor lines in the first conductor group are in conduction to each other are located between the central positions of the conductor lines exclusive and the open ends inclusive, and the positions where the conductor lines in the second conductor group are in conduction to each other are located between the central positions of the conductor lines exclusive and the open ends inclusive. Thus, the conduction at the positions close to the open end side facilitates to suppress any unnecessary resonance mode.

Alternatively, the stacked resonator may include a first through-hole bringing the conductor lines in the first conductor group into conduction to each other, and a second through-hole bringing the conductor lines in the second conductor group into conduction to each other. Thus, the respective conductor lines in the first and second conductor group can be in conduction to each other with the first and second through-holes interposed therebetween, respectively.

Alternatively, the stacked resonator may include a first connecting terminal used to bring the conductor lines in the first conductor group into conduction to each other, and a second connecting terminal used to bring the conductor lines in the second conductor group into conduction to each other. Thus, the respective conductor lines in the first and second conductor group can be in conduction to each other with the first and second connecting terminals interposed therebetween, respectively.

Hence, the stacked resonator of the embodiment of the present invention is capable of facilitating miniaturization and minimum loss because the stacked resonator can be formed by regarding the first conductor group in whole as one resonator, and the second group in whole as other resonator, and equivalently establishing the interdigital-coupling of the pair of resonators each using one end thereof as an open end, and the other end thereof as a short-circuit end. Further, any unnecessary resonance mode of a high frequency due to the interdigital-coupling can be suppressed by bringing the conductor lines in the first and second conductor groups into conduction to each other at the positions other than the short-circuit ends, respectively.

Other and further objects, features and advantages of the invention will appear more fully from the following description.

BRIEF DESCRIPTION OF THE DRAWINGS

FIG. 7 is an explanatory drawing illustrating a distribution state of resonance frequency in the pair of interdigital-coupled quarter-wave resonators;

FIGS. 8A and 8B are a first explanatory drawing and a second explanatory drawing illustrating a magnetic field distribution in the pair of interdigital-coupled quarter-wave resonators, respectively;

FIG. 12 is an explanatory drawing illustrating a basic configuration of a stacked resonator according to a second embodiment of the present invention;

FIGS. 13A and 13B are explanatory drawings illustrating a connecting position between conductors in the stacked resonator of the second embodiment;

DESCRIPTION OF THE PREFERRED EMBODIMENTS

Preferred embodiments of the present invention will now be described in detail with reference to the accompanying drawings.

First Embodiment

Figure 1:
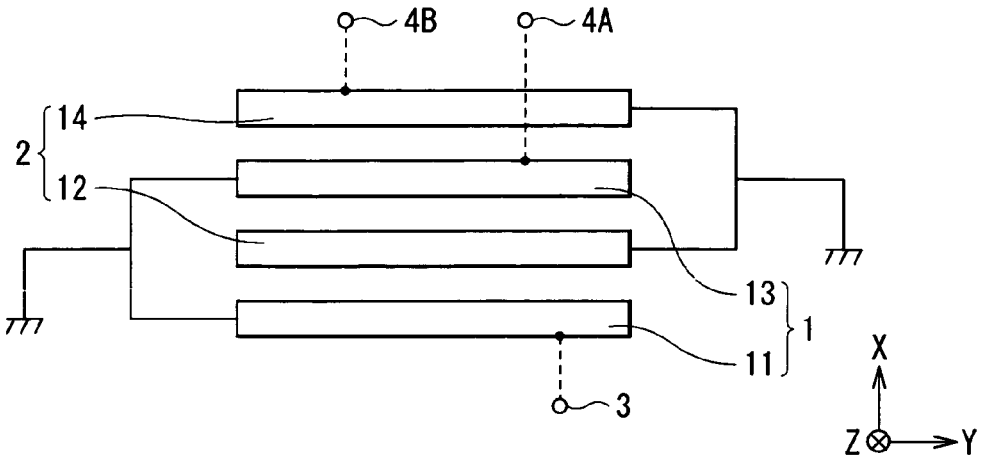
FIG. 1 is an explanatory drawing illustrating a basic configuration of a stacked resonator according to a first embodiment of the present invention.

First, a stacked resonator according to a first embodiment of the present invention will be described. FIG. 1 illustrates a basic configuration of the stacked resonator of the present embodiment. The stacked resonator includes a first conductor group 1 and a second conductor group 2. The first conductor group 1 has a plurality of conductor lines 11 and 13 in a stacking arrangement. The second conductor group 2 has a plurality of other conductor lines 12 and 14 in a stacking arrangement so as to alternately oppose to the conductor lines 11 and 13 of the first conductor group 1, thereby establishing an interdigital-coupling to the first conductor group 1. Although the present embodiment describes the stacked resonator in which the four conductor lines 11, 12, 13, and 14 as a whole are arranged by stacking them in sequence from the lower layer side, the number of conductor lines stacked is not limited to this, and more lines may be used. As the number of stacked conductor lines increases, the individual lines can be designed in a smaller length, permitting further miniaturization. Moreover, the total number of the stacked conductor lines is not required to be an even number. Alternatively, the total of conductor lines may be an odd number.

When the stacked resonator is used to configure a filter or the like, an input terminal may be connected to, for example, at least one conductor line on the lower layer side, and an output terminal may be connected to, for example, at least one conductor line on the upper layer side. For example, when configuring an unbalanced input/balanced output type filter, an unbalanced terminal 3 as an input terminal may be connected to the conductor line 11 on the lower layer side, and a pair of balanced output terminals 4A and 4B as output terminals may be connected to the two conductor lines 13 and 14 on the upper layer side. A balanced input/unbalanced output type filter, and a balanced input/balanced output type filter can be configured in the same manner. When connecting balanced terminals, one of a pair of balanced terminals is connected to a conductor line of one conductor group, and the other is connected to a conductor line of the other conductor group.

The ends of the conductor lines 11 and 13 on one side thereof in the first conductor group 1 are used as short-circuit ends, respectively, and the ends on the other side thereof are used as open ends, respectively. The ends of the conductor lines 12 and 14 in the second conductor group 2, which oppose to the open ends of the conductor lines 11 and 13 in the first conductor group, are used as short-circuit ends, respectively, and the ends thereof opposing to the short-circuit ends of the conductor lines 11 and 13 are used as open ends, respectively. This establishes the interdigital-coupling between the first conductor group 1 and the second conductor group 2. Here, when the first conductor group 1 is regarded in whole as one resonator, and the second group 2 is regarded in whole as other resonator, it can be considered that the result is equivalent to a stacked resonator configured of a pair of interdigital-coupled resonators each using one end thereof as an open end, and the other end thereof as a short-circuit end. As used herein, the pair of interdigital-connected resonators means electromagnetically-coupled resonators attained by arranging so that the open end of one resonator is opposed to the short-circuit end of the other resonator, and the short-circuit end of the one resonator is opposed to the open end of the other resonator.

The main components of the stacked resonator are configured to have a TEM line. For example, the TEM line can be configured of a conductor pattern such as a strip line or a through conductor formed in the inside of a dielectric substrate. The term "TEM line" means a transmission line for transmitting an electromagnetic wave (a TEM wave) in which both of an electric field and a magnetic field exist only within a cross section perpendicular to a traveling direction of the electromagnetic wave.

Figure 2:
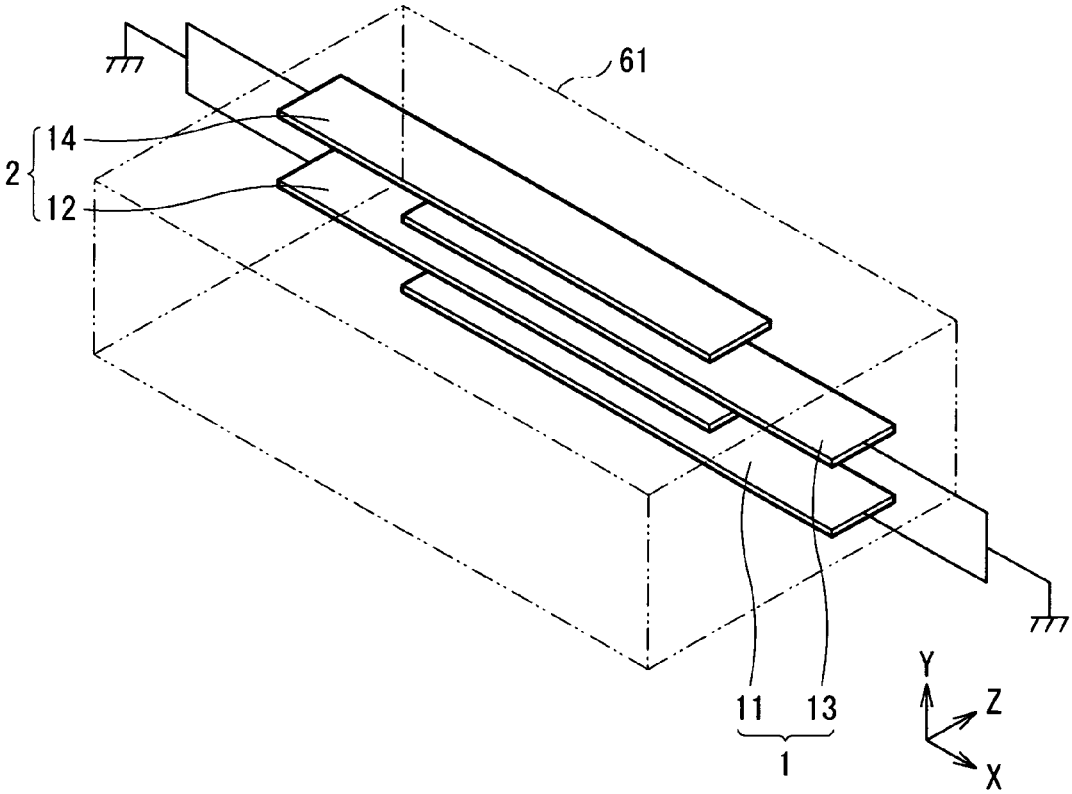
FIG. 2 is a perspective view illustrating a specific configuration example of the stacked resonator in the first embodiment.

FIG. 2 illustrates a specific example of the configuration of the above-mentioned stacked resonator. This example is provided with a dielectric substrate 61 formed of a dielectric material, and the dielectric substrate 61 has a multilayer structure. A line pattern (a strip line) of the conductor is formed in the inside of the dielectric substrate 61, and this line pattern is used to form the conductor lines 11 and 13 of the first conductor group 1, and the conductor lines 12 and 14 of the second conductor group 2. To obtain this structure, for example, a laminate structure may be formed by the steps of: preparing a plurality of sheet-shaped dielectric substrates; forming individual line portions on the sheet-shaped dielectric substrates by using the line pattern of a conductor; and laminating the sheet-shaped dielectric substrates.

Although not illustrated, the dielectric substrate 61 is provided with a ground layer for grounding the short-circuit ends of the conductor lines 11 and 13 in the first conductor group 1, and for grounding the short-circuit ends of the conductor lines 12 and 14 in the second conductor group 2. For example, the ground layer can be disposed on the upper surface, the bottom surface, or the inside of the dielectric substrate 61. In this case, for example, on the side surface of the dielectric substrate 61 where the respective conductor lines extend, the surfaces of the short-circuit ends of the respective conductor lines may be exposed, and a connecting conductor pattern for connecting to the ground layer may be disposed on the side surface of the part thus exposed, so that the individual short-circuit ends of the respective conductor lines are in conduction to the ground layer with the connecting conductor pattern interposed therebetween. Alternatively, a through-hole may be formed between each of the short-circuit ends of the respective conductor lines and the ground layer, so that the conduction between the two can be established with the through-hole interposed therebetween.

The operation of the stacked resonator according to the first embodiment will be described below.

In the stacked resonator, when the first conductor group 1 is regarded in whole as one resonator, and the second group 2 is regarded in whole as other resonator, the result can be equivalently to a stacked resonator configured of a pair of interdigital-coupled resonators each using one end thereof as an open end, and the other end thereof as a short-circuit end. When a pair of resonators are of interdigital type and strongly coupled to each other, with respect to a resonance frequency $f_0$ in each of the resonators when establishing no interdigital-coupling (i.e., the resonance frequency determined by the physical length of a quarter-wave), there appears two resonance modes of a first resonance mode that resonates at a first resonance frequency $f_1$ higher than the resonance frequency $f_0$, and a second resonance mode that resonates at a second resonance frequency $f_2$ lower than the first resonance frequency $f_1$, and the resonance frequency is then divided into two. In this case, by setting, as an operating frequency as a resonator, the second resonance frequency $f_2$ lower than the resonance frequency $f_0$ corresponding to the physical length, miniaturization can be facilitated than setting the operating frequency to the resonance frequency $f_0$. Further, in the second resonance mode of a lower frequency, the current i flows in the same direction to the respective conductor lines in each conductor group, and the conductor thickness can be assumed to be increased thereby to reduce the conductor loss.

The following is a more detailed description of the operation and effect obtainable from the interdigital-coupling. Techniques for coupling two resonators configured of the TEM line are of two general types: comb-line coupling, and intergital-coupling. It is known that interdigital coupling produces extremely strong coupling.

Figure 3:
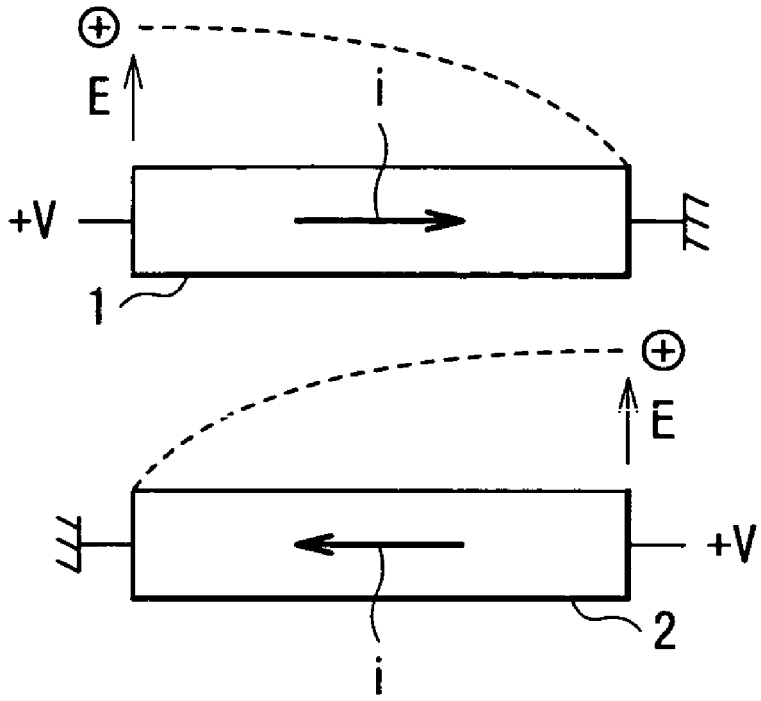
FIG. 3 is an explanatory drawing illustrating a first resonance mode of a pair of interdigital-coupled quarter-wave resonators.
Figure 4:
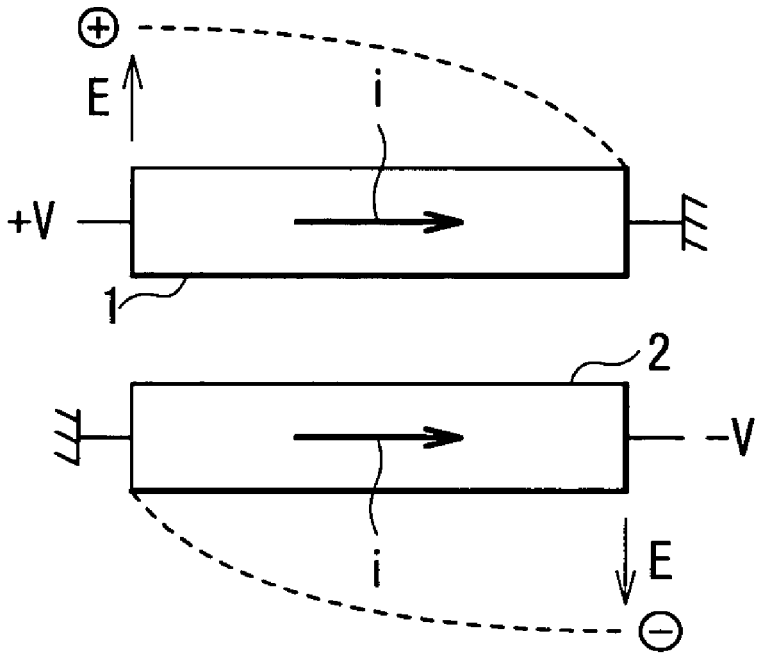
FIG. 4 is an explanatory drawing illustrating a second resonance mode of the pair of interdigital-coupled quarter-wave resonators.

In the pair of interdigital-coupled resonators (in the present embodiment, provided that the first conductor group 1 and the second conductor group 2 configure equivalently a pair of resonators), a resonance condition can be divided into two inherent resonance modes. FIG. 3 illustrates a first resonance mode in the pair of quarter-wave resonators, and FIG. 4 illustrates a second resonance mode. In FIGS. 3 and 4, the curves indicated by the broken line represent distributions of an electric field E in the respective resonators.

In the first resonance mode, a current i flows from the open end side to the short-circuit end side in the pair of quarter-wave resonators, respectively, and the currents i passing through these resonators reverse in direction. In the first resonance mode, an electromagnetic wave is excited in the same phase by the pair of quarter-wave resonators.

On the other hand, in the second resonance mode, the current i flows from the open end side to the short-circuit end side in one the quarter-wave resonator (the first conductor group 1), and the current i flows from the short-circuit end side to the open end side in the other the quarter-wave resonator (the second conductor group 2), so that the currents i passing through these resonators in the same direction. That is, in the second resonance mode, an electromagnetic wave is excited in reversed-phase by the pair of quarter-wave resonators, as can be seen from the distribution of the electric field E. In the second resonance mode, the phase of the electric field E is shifted 180 degrees at such positions as to be mutually rotational symmetry with respect to a physical axis of rotational symmetry, as a whole of the pair of quarter-wave resonators.

The resonance frequency of the first resonance mode can be expressed by $f_1$ in the following equation (1A), and the resonance frequency of the second resonance mode can be expressed by $f_2$ in the following equation (1B) in case of rotationally-symmetrical structure.

$$\begin{cases} f_1 = \dfrac{c}{\pi\sqrt{\varepsilon_r}l}\tan^{-1}\left(\sqrt{\dfrac{Z_e}{Z_o}}\right) & \text{(1A)} \\ f_2 = \dfrac{c}{\pi\sqrt{\varepsilon_r}l}\tan^{-1}\left(\sqrt{\dfrac{Z_o}{Z_e}}\right) & \text{(1B)} \end{cases}$$

wherein c is a light velocity; $\in_r$ is an effective relative dielectric constant; 1 is a resonator length; $Z_e$ is a characteristic impedance of an even mode; and $Z_o$ is a characteristic impedance of an odd mode.

In a coupling transmission line of bilateral symmetry, a transmission mode for propagating to the transmission line can be decomposed into two independent modes of an even mode and an odd mode (which do not interfere with each other).

Figure 5A:
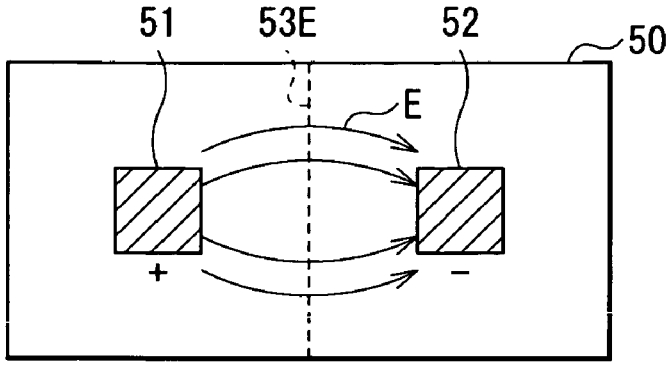
FIGS. 5A and 5B are explanatory drawings illustrating an electric field distribution in an odd mode in transmission modes of a coupling transmission line of bilateral symmetry, and an electric field distribution in an even mode, respectively.
Figure 5B:
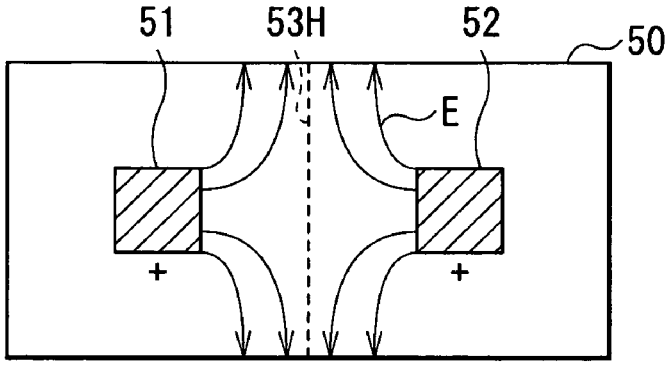

FIG. 5A illustrates a distribution of the electric field E in the odd mode of the coupling transmission line, and FIG. 5B illustrates a distribution of the electric field E in the even mode. In FIGS. 5A and 5B, a ground layer 50 is formed at a peripheral portion, and conductor lines 51 and 52 of bilateral symmetry are formed in the inside. FIGS. 5A and 5B illustrate electric field distributions within a cross section orthogonal to a transmission direction of the coupling transmission line, and the direction of transmission of a signal is orthogonal to the drawing surface.

Figure 6A:
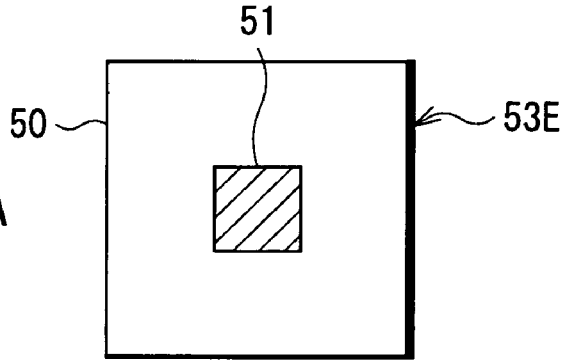
FIGS. 6A and 6B are explanatory drawings illustrating the structure of a transmission line equivalent to the coupling transmission line of bilateral symmetry, FIGS. 6A and 6B illustrating an odd mode and an even mode in the equivalent transmission line, respectively.

As illustrated in FIG. 5A, in the odd mode, the electric fields cross perpendicularly with respect to a symmetrical plane of the conductor lines 51 and 52, and the symmetrical plane becomes a virtual electrical wall 53E. FIG. 6A illustrates a transmission line equivalent to that illustrated in FIG. 5A. As illustrated in FIG. 6A, a structure equivalent to the line configured only of the conductor line 51 can be obtained by replacing the symmetrical plane with the actual electrical wall 53E (a wall of zero potential, or a ground). The characteristic impedance by the line illustrated in FIG. 6A becomes a characteristic impedance $Z_0$ in the odd mode in the above-mentioned equations (1A) and (1B).

Figure 6B:
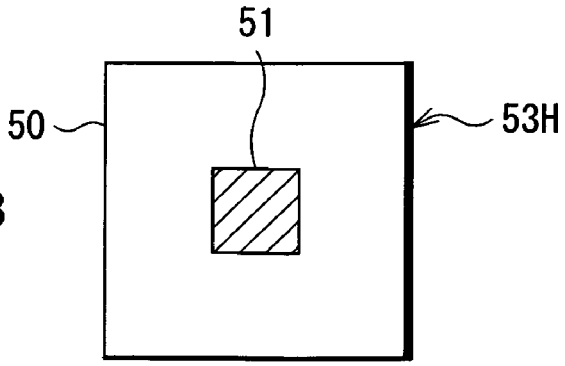

On the other hand, in the even mode, the electric fields are balanced with respect to a symmetrical plane of the conductor lines 51 and 52, as illustrated in FIG. 5B, so that the magnetic fields cross perpendicularly with respect to the symmetrical plane. In the even mode, the symmetrical plane becomes a virtual magnetic wall 53H. FIG. 6B illustrates a transmission line equivalent to that illustrated in FIG. 5B. As illustrated in FIG. 6B, a structure equivalent to the line configured only of the conductor line 51 can be obtained by replacing the symmetrical plane with the actual magnetic wall 53H (a wall whose impedance is infinity). The characteristic impedance by the line illustrated in FIG. 6B becomes a characteristic impedance $Z_e$ in the even mode in the above-mentioned equations (1A) and (1B).

In general, a characteristic impedance Z of a transmission line can be expressed by a ratio of a capacity C with respect to a ground per unit length of a signal line, and an inductance component L per unit length of a signal line. That is, $$Z=\sqrt{(L/C)} \quad (2)$$

wherein √ indicates a square root of the entire (L/C).

In the characteristic impedance $Z_o$ in the odd mode, the symmetrical plane becomes a ground (the electric wall 53E) from the line structure of FIG. 6A, and the capacity C with respect to the ground is increased. Hence, from the equation (2), the value of $Z_o$ is decreased. On the other hand, in the characteristic impedance $Z_e$ in the even mode, the symmetrical plane becomes the magnetic wall 53H from the line structure of FIG. 6B, and the capacity C is decreased. Hence, from the equation (2), the value of $Z_e$ is increased.

Taking the above-described matter into account, consider now the equations (1A) and (1B), which are the resonance frequencies of the resonance modes of the pair of quarter-wave resonators that are interdigital-coupled. Since the function of an arc tangent is a monotone increasing function, the resonance frequency increases with an increase in a portion regarding $\tan^{-1}$ in the equations (1A) and (1B), and decreases with a decrease in the portion. That is, the value of the characteristic impedance $Z_o$ in the odd mode is decreased, and the value of the characteristic impedance $Z_e$ in the even mode is increased. As the difference therebetween increases, the resonance frequency $f_1$ of the first resonance mode increases from the equation (1A), and the resonance frequency $f_2$ of the second resonance mode decreases from the equation (1B).

Accordingly, by increasing the ratio of the symmetrical plane of transmission paths to be coupled, the first resonance frequency $f_1$ and the second resonance frequency $f_2$ depart from each other, as illustrated in FIG. 7. FIG. 7 illustrates a distribution state of resonance frequencies in the pair of interdigital-coupled quarter-wave resonators. An intermediate resonance frequency $f_o$ of the first resonance frequency $f_1$ and the second resonance frequency $f_2$ is a frequency at the time of resonance at a quarter-wave that is determined by the physical length of a line (i.e., the resonance frequency in each of the quarter-wave resonators when establishing no interdigital-coupling). Here, increasing the ratio of the symmetrical plane of the transmission paths corresponds to increasing the capacity C in the odd mode from the equation (2). Increasing the capacity C corresponds to enhancing the degree of coupling of a line. Therefore, in the pair of interdigital-coupled quarter-wave resonators, a stronger coupling between the resonators causes further separation between the first resonance frequency $f_1$ and the second resonance frequency $f_2$.

The strong coupling between the pair of quarter-wave resonators of interdigital type provides the following advantages. That is, the resonance frequency $f_0$ that is determined by the physical length of a quarter-wave can be divided into two. Specifically, there occur a first resonance mode that resonates at a first resonance frequency $f_1$ higher than a resonance frequency $f_0$, and a second resonance mode that resonates at a second resonance frequency $f_2$ lower than the resonance frequency $f_0$.

In this case, by setting the second resonance frequency $f_2$ of a low frequency as an operating frequency (a passing frequency if configured as a filter), there is a first advantage of further reducing the dimension of the entire resonator than setting the operating frequency to the resonance frequency $f_0$. For example, when a filter is designed by setting 2.4 GHz band as a passing frequency, it is possible to use a quarter-wave resonator whose physical length corresponds to 8 GHz, for example. This is smaller than the quarter-wave resonator whose physical length corresponds to 2.4 GHz band. That is, this permits further miniaturization than a comb-line coupled resonator structure.

A second advantage is that the coupling of the balanced terminal leads to superior balance characteristics. As described above with reference to FIGS. 3 and 4, the pair of interdigital-coupled quarter-wave resonators are excited in the same phase in the first resonance mode, and excited in reversed-phase in the second resonance mode. Therefore, no common-mode is excited, and only a reverse phase exists with respect to a filter passing frequency (namely the second resonance frequency $f_2$), by allowing the pair of quarter-wave resonators to be strongly interdigital-coupled, and setting the first resonance frequency $f_1$ to a sufficiently high value that is satisfactorily away from the second resonance frequency $f_2$. This improves balance characteristics. From the point of view of this, it is preferable that the first resonance frequency $f_1$ is sufficiently higher than the frequency band of an input signal. For example, it is preferable that the first resonance frequency $f_1$ exceeds three times the second resonance frequency $f_2$. That is, it is preferable to satisfy the following condition:

$$f_1 > 3f_2$$

If the second resonance frequency $f_2$ of a lower frequency is set to the filter passing frequency, frequency characteristics may be deteriorated when the frequency band of the input signal overlaps with the first resonance frequency $f_1$. This is avoidable by setting the first resonance frequency $f_1$ to be higher than the frequency band of the input signal.

A third advantage is that conductor loss can be reduced. FIGS. 8A and 8B illustrate schematically a distribution of a magnetic field H in the pair of interdigital-coupled quarter-wave resonators. Specifically, FIGS. 8A and 8B illustrate magnetic field distributions within a cross section orthogonal to the direction of flow of the current i in the second resonance mode in the pair of quarter-wave resonators as illustrated in FIG. 4. The direction of flow of the current i is a direction orthogonal to the drawing surface. In the second resonance mode, as illustrated in FIG. 8A, the magnetic field H is distributed in the same direction (for example, in a counterclockwise direction) within the cross section in the pair of quarter-wave resonators. In this case, when these resonators are strongly interdigital-coupled (these resonators are brought into closer relationship), this leads to a magnetic field distribution equivalent to a state in which the pair of quarter-wave resonators (all of the conductor lines configuring the conductor groups 1 and 2 in the present embodiment) are assumed to be a single conductor, as illustrated in FIG. 8B. That is, the conductor thickness can be assumed to be increased, and hence the conductor loss is decreased.

As discussed above, the first embodiment facilitates the miniaturization and the minimum loss because the stacked resonator can be formed by regarding the first conductor group in whole as one resonator, and the second group in whole as other resonator, and equivalently establishing the interdigital-coupling of the pair of resonators each using one end thereof as an open end, and the other end thereof as a short-circuit end.

Figure 9:
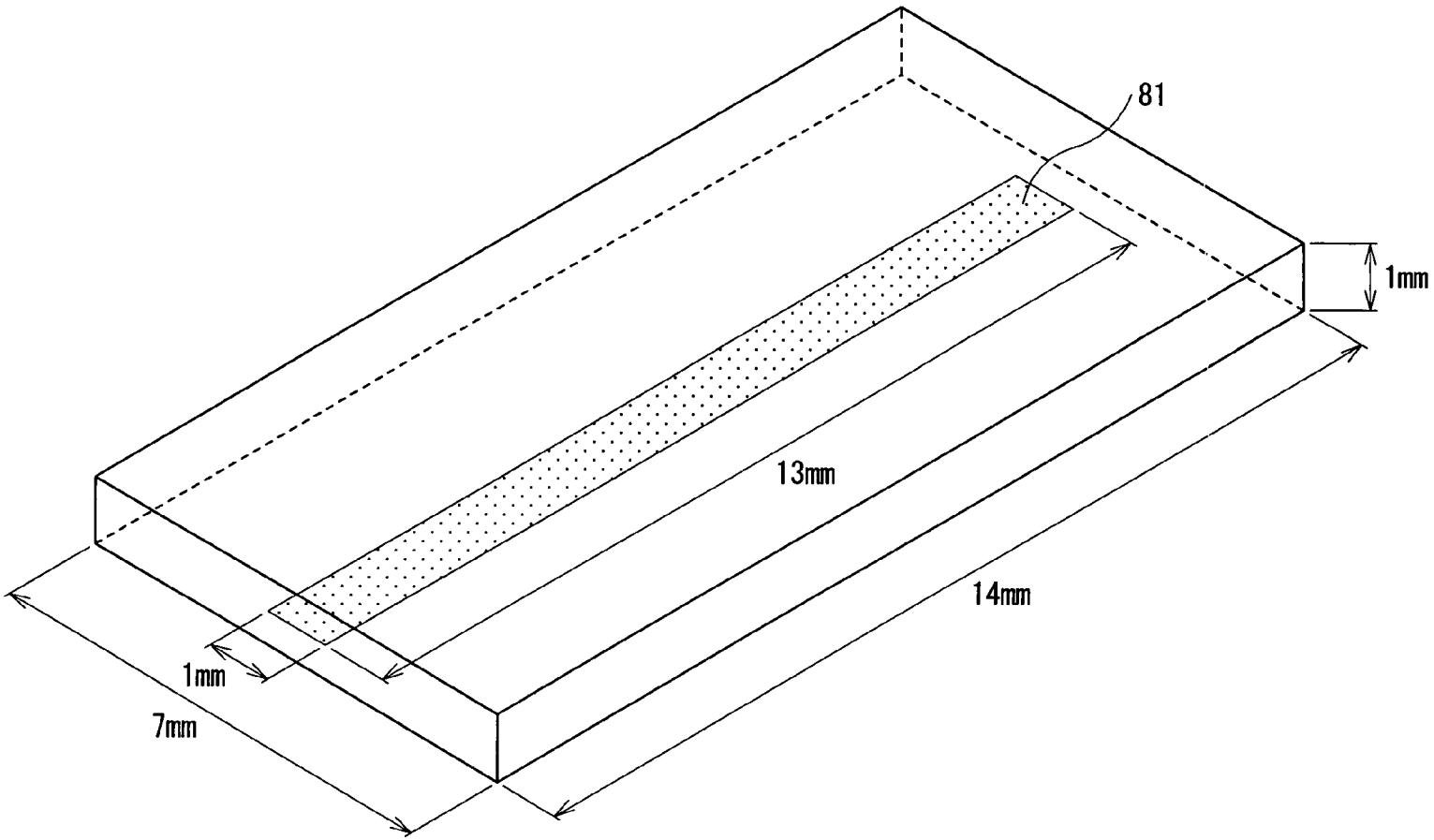
FIG. 9 is a structural drawing illustrating an example of the dimension of a resonator structure using only one quarter-wave resonator.

Based on an actual design example, the miniaturization and transmission efficiency because of the stacking arrangement of the conductor lines will be described below, taking as example the case of stacking arrangement of quarter-wave resonators as conductor lines. FIG. 9 is a design example when a conductor line pattern is formed in the inside of a dielectric substrate, and the pattern is used to form only one layer of quarter-wave resonator 81. As illustrated in the figure, the longitudinal dimension of the dielectric substrate is 14 mm, and the lateral dimension is 7 mm. The quarter-wave resonator 81 has a length of 13 mm, and a width of 1 mm. The resonance frequency and the Q value in this design example have the following values:

Resonance frequency: about 2.0 GHz

Q value: about 91.9

Since this resonance frequency is a resonance frequency in the quarter-wave resonator 81 alone, it is equivalent to the intermediate resonance frequency $f_0$.

Figure 10:
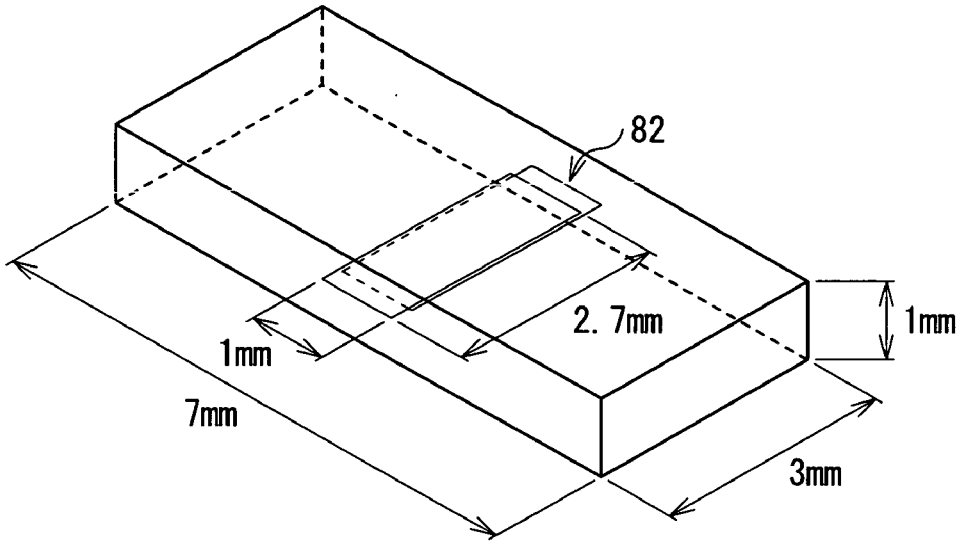
FIG. 10 is a structural drawing illustrating an example of the dimension of a resonator structure using two quarter-wave resonators as a whole.

FIG. 10 is a design example where a resonator 82 is configured of a pair of interdigital-coupled quarter-wave resonators by arranging two quarter-wave resonators in a stacked relationship at spaced intervals, with respect to the design example of FIG. 9. As illustrated in FIG. 10, the longitudinal dimension of the dielectric substrate is 7 mm, and the lateral dimension is 3 mm. Each of the quarter-wave resonators 82 has a length of 2.7 mm, and a width of 1 mm. The resonance frequency and the Q value in this design example have the following values:

Resonance frequency (Signal passing band): about 2.1 GHz

Q value: about 96.4

This resonance frequency is a second resonance frequency $f_2$ of a low frequency (the second resonance frequency $f_2$ illustrated in FIG. 7). In spite of almost the same resonance frequency itself, the configuration of FIG. 10 can be considerably miniaturized and has a higher Q value (higher transmission efficiency) than that in FIG. 9.

Figure 11:
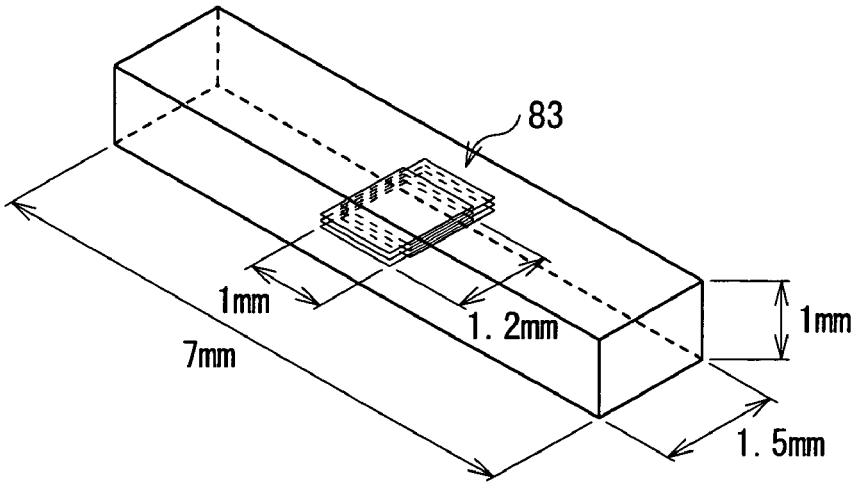
FIG. 11 is a structural drawing illustrating an example of the dimension of a resonator structure using six quarter-wave resonators as a whole.

FIG. 11 is a design example where a resonator 83 is formed by arranging six quarter-wave resonators as a whole in a stacked relationship at spaced intervals, and then subjecting them to alternate interdigital-coupling, with respect to the design example of FIG. 9. As illustrated in FIG. 11, the longitudinal dimension of the dielectric substrate is 7 mm, and the lateral dimension is 1.5 mm. Each of the quarter-wave resonators has a length of 1.2 mm, and a width of 1 mm. The resonance frequency and the Q value in this design example have the following values:

Resonance frequency (Signal passing band): about 2.3 GHz

Q value: about 151.3

This resonance frequency is the second resonance frequency $f_2$ of a low frequency (the second resonance frequency $f_2$ illustrated in FIG. 7). In spite of almost the same resonance frequency itself, further miniaturization and a high Q value than the configuration of FIG. 10 can be achieved by increasing the number of quarter-wave resonators stacked.

Thus, a larger number of the quarter-wave resonators stacked enable the physical length of each quarter-wave resonator to be designed in a smaller length. This permits further miniaturization of the overall configuration, and also increases transmission efficiency.

Second Embodiment

A stacked resonator according to a second embodiment of the present invention will next be described. The same reference numerals have been used as in the above-mentioned first embodiment for substantially identical components, with the description thereof omitted.

FIG. 12 illustrates a basic configuration of the stacked resonator of the second embodiment. In the stacked resonator, the conductor lines of first and second conductor groups 1 and 2 are in conduction to each other at a position other than short-circuit ends, respectively. Conductor lines 11 and 13 of the first conductor group 1 are in conduction to each other at positions other than the short-circuit ends of the conductor lines 11 and 13, respectively. Similarly, conductor lines 12 and 14 of the second conductor group 2 are in conduction to each other at positions other than the short-circuit ends of the conductor lines 12 and 14, respectively. As illustrated in FIG. 13B, the conductor lines 11 and 13 of the first conductor group 1 are preferably in conduction to each other at positions on the open end side than central positions 5 of the conductor lines 11 and 13, respectively. Similarly, as illustrated in FIG. 13A, the conductor lines 12 and 14 of the second conductor group 2 are preferably in conduction to each other at positions on the open end side than central positions 6 of the conductor lines 12 and 14, respectively. Thus, the conduction at the positions close to the open end side facilitates to suppress any unnecessary resonance mode as will be described later. Preferably, the stacked direction of the conductor lines 11, 12, 13, and 14 are arranged with equal spacing.

Figure 14:
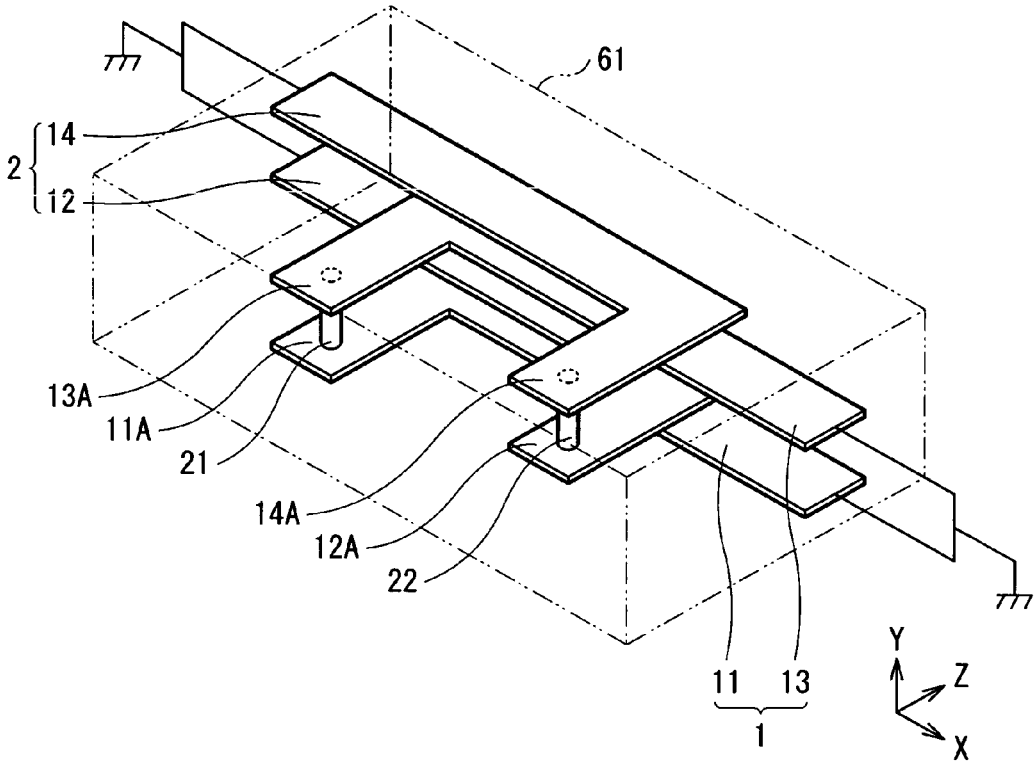
FIG. 14 is a perspective view illustrating a first specific configuration example of the stacked resonator in the second embodiment.
Figure 15:
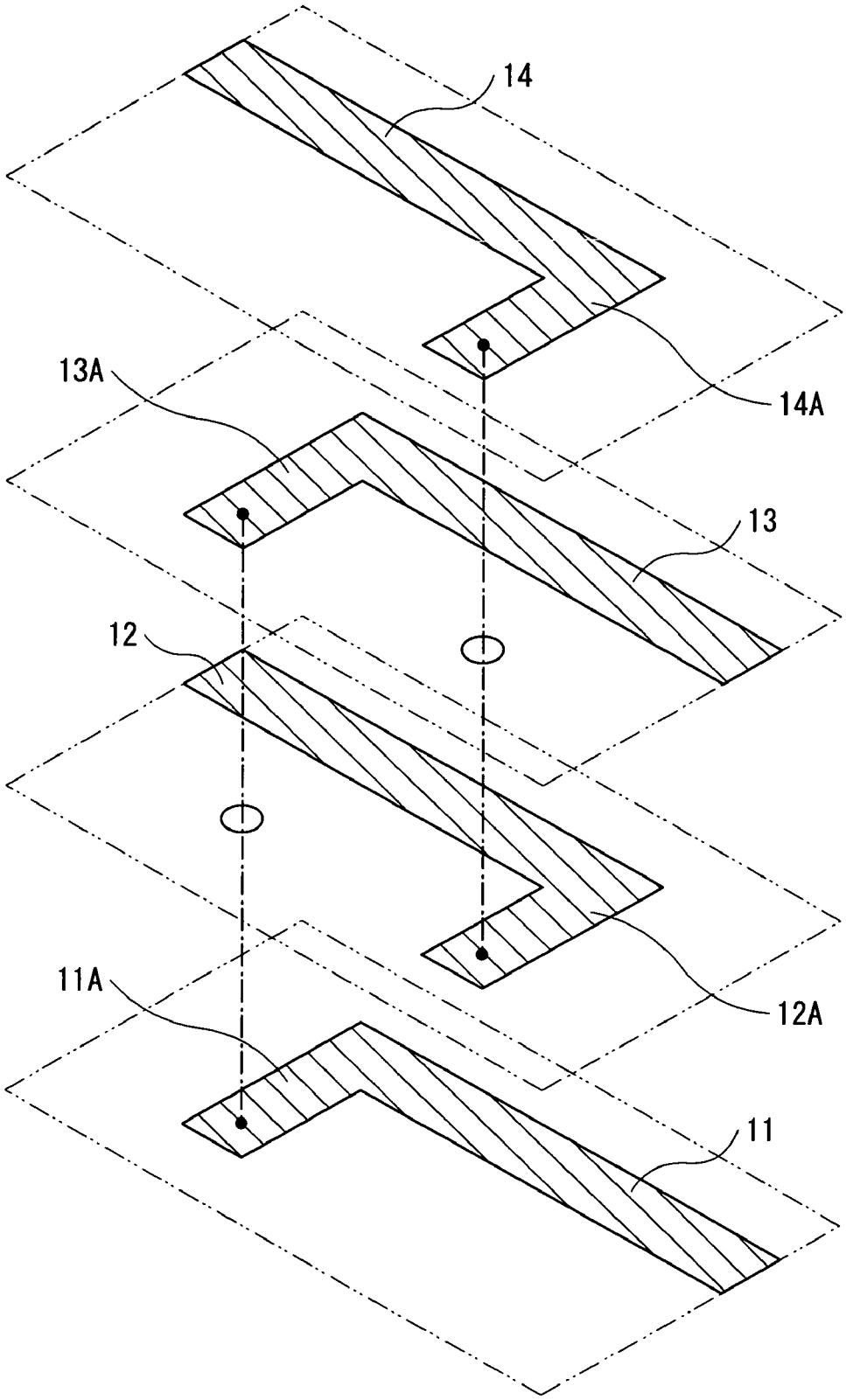
FIG. 15 is an exploded perspective view illustrating the first specific configuration example of the stacked resonator in the second embodiment.

FIGS. 14 and 15 illustrate a first specific configuration example of the above-mentioned stacked resonator. The first configuration example has a dielectric substrate 61 made of a dielectric material, and the dielectric substrate 61 has a multilayer structure. A line pattern (a strip line) of the conductor is formed in the inside of the dielectric substrate 61, and this line pattern is used to form the conductor lines 11 and 13 of the first conductor group 1, and the conductor lines 12 and 14 of the second conductor group 2. To obtain this structure, for example, a laminate structure may be formed by the steps of: preparing a plurality of sheet-shaped dielectric substrates; forming individual line portions on the sheet-shaped dielectric substrates by using the line pattern of a conductor; and laminating the sheet-shaped dielectric substrates.

The stacked resonator of the first configuration example is further provided with a first through-hole 21 bringing the conductor lines 11 and 13 of the first conductor group 1 into conduction to each other, and a second through-hole 22 bringing the conductor lines 12 and 14 of the second conductor group 2 into conduction to each other. The internal surfaces of the first and second through-holes 21 and 22 are metallized. Further, conductor leading parts 11A and 13A are disposed on the open end sides of the conductor lines 11 and 13 of the first conductor group 1, respectively, and other conductor leading parts 12A and 14A are disposed on the open end sides of the conductor lines 12 and 14 of the second conductor group 2, respectively.

The first through-hole 21 is disposed between the leading parts 11A and 13A so as to penetrate the leading parts 11A and 13A. This causes the conductor lines 11 and 13 of the first conductor group 1 to be conducting to each other with the leading parts 11A and 13A and the first through-hole 21 interposed therebetween. Similarly, the second through-hole 22 is disposed between the leading parts 12A and 14A so as to penetrate the leading parts 12A and 14A. This causes the conductor lines 12 and 14 of the second conductor group 2 to be conducting to each other with the leading parts 12A and 14A and the second through-hole 22 interposed therebetween.

Figure 16:
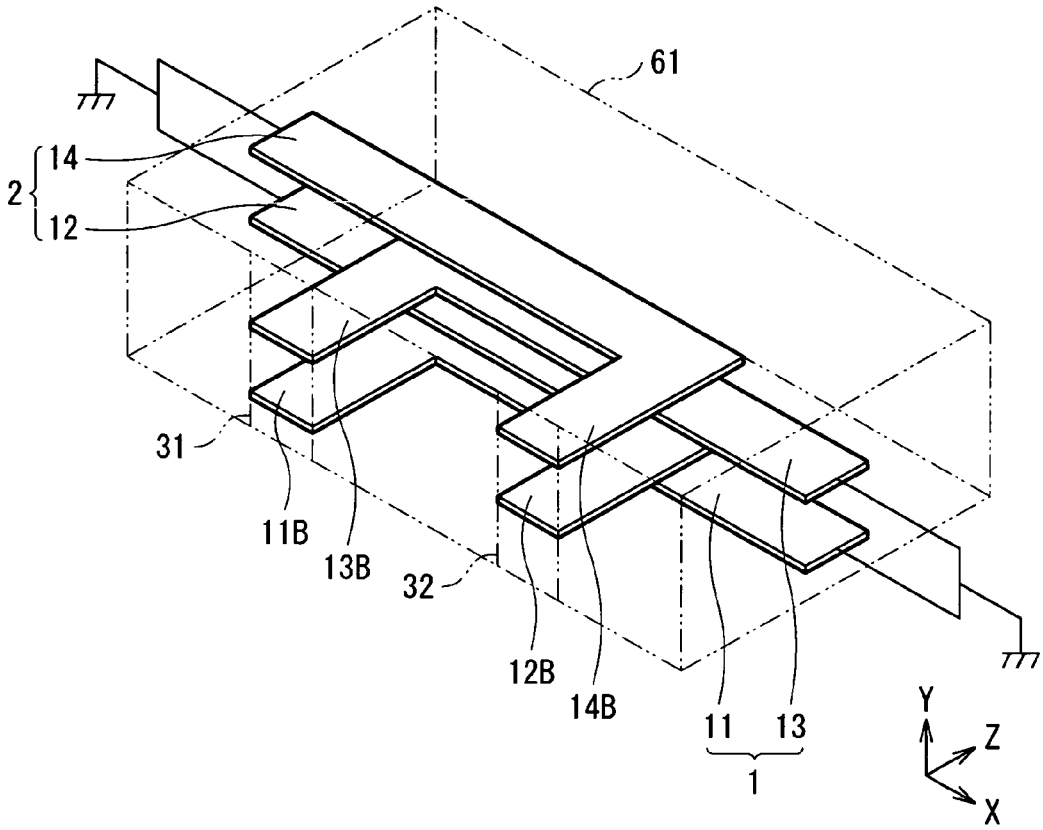
FIG. 16 is a perspective view illustrating a second specific configuration example of the stacked resonator in the second embodiment.
Figure 17:
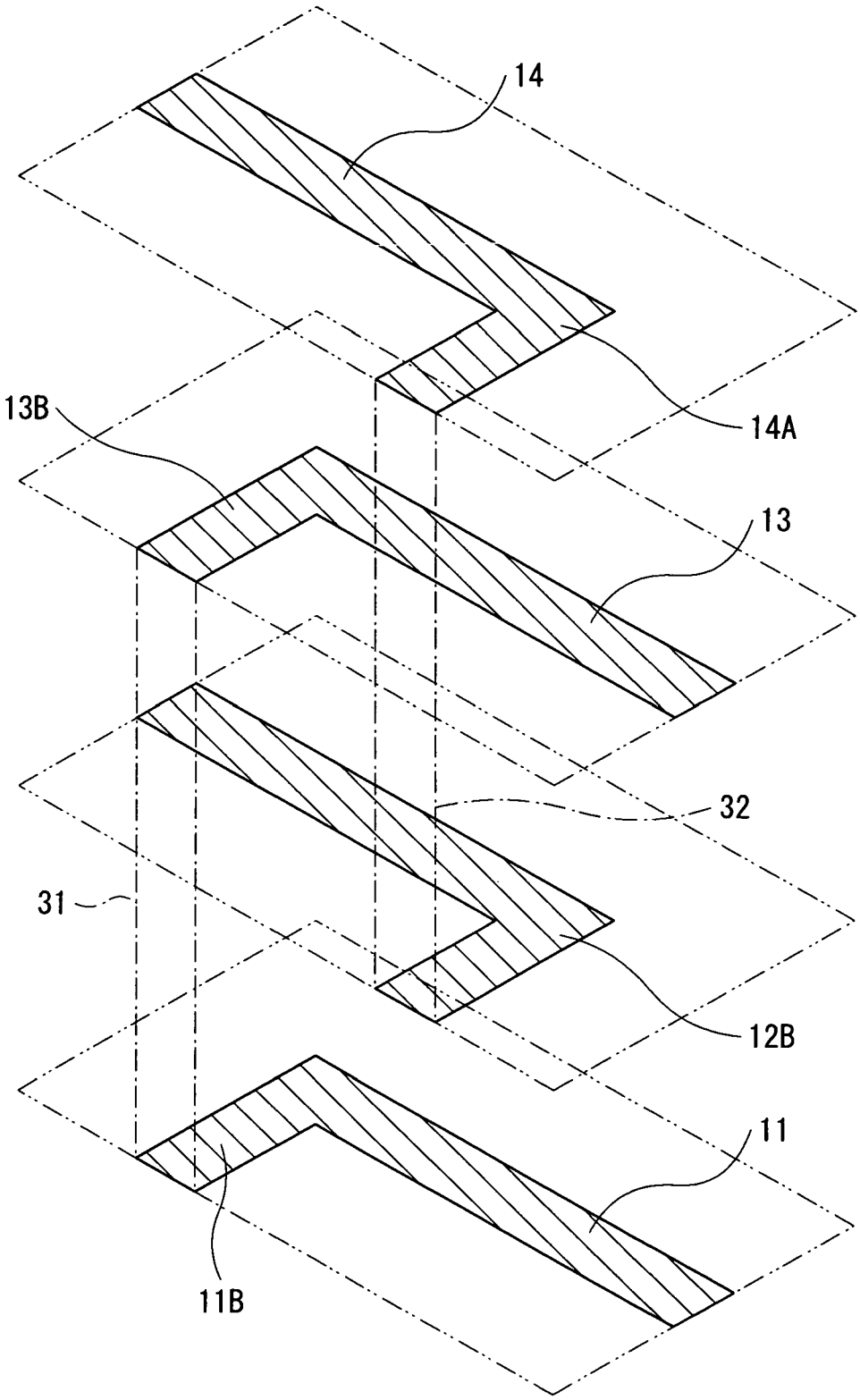
FIG. 17 is an exploded perspective view illustrating the second specific configuration example of the stacked resonator in the second embodiment.

FIGS. 16 and 17 illustrate a second specific configuration example of the above-mentioned stacked resonator. The second configuration example is identical with the first configuration example, except for the configuration of connecting portions on the open end sides in the first conductor group 1 and the second conductor group 2, respectively.

In the stacked resonator of the second configuration example, first connecting terminals 11B and 13B formed of a conductor, which bring the conductor lines 11 and 13 into conduction to each other, are disposed on the open end sides of the conductor lines 11 and 13 of the first conductor group 1, respectively. Similarly, second connecting terminals 12B and 14B formed of a conductor, which bring the conductor lines 12 and 14 into conduction to each other, are disposed on the open end sides of the conductor lines 12 and 14 of the second conductor group 2, respectively. Further, one side surface of the dielectric substrate 61 is provided with conductor patterns 31 and 32 for connection. The first connecting terminals 11B and 13B extend to one side surface of the dielectric substrate 61 so that each one end of the second connecting terminals 11B and 13B is connected to the first connecting conductor pattern 31. This causes the conductor lines 11 and 13 of the first conductor group 1 to be conducting to each other, with the first connecting terminals 11B and 13B and the first connecting conductor pattern 31. Similarly, the second connecting terminals 12B and 14B extend to one side surface of the dielectric substrate 61 so that each one end of the second connecting terminals 12B and 14B is connected to the second connecting conductor pattern 32. This causes the conductor lines 12 and 14 of the second conductor group 2 to be conducting to each other, with the second connecting terminals 12B and 14B and the second connecting conductor pattern 32.

In this stacked resonator, the conductor lines in the first and second conductor groups 1 and 2 are in conduction at positions other than the short-circuit ends, respectively, enabling to suppress any unnecessary resonance mode (a higher resonance mode having a high frequency than the second resonance mode) due to interdigital-coupling. The followings are the operation and effect obtained from the configuration that the conductor lines in the first and second conductor groups 1 and 2 are in conduction to each other at positions other than the short-circuit ends, respectively.

Figure 18:
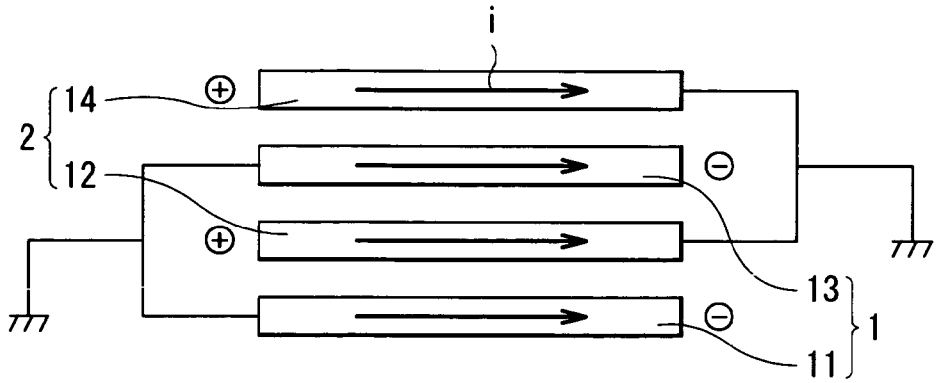
FIG. 18 is an explanatory drawing illustrating a current distribution in a resonance mode on a low frequency side in the stacked resonator of the second embodiment.
Figure 19:
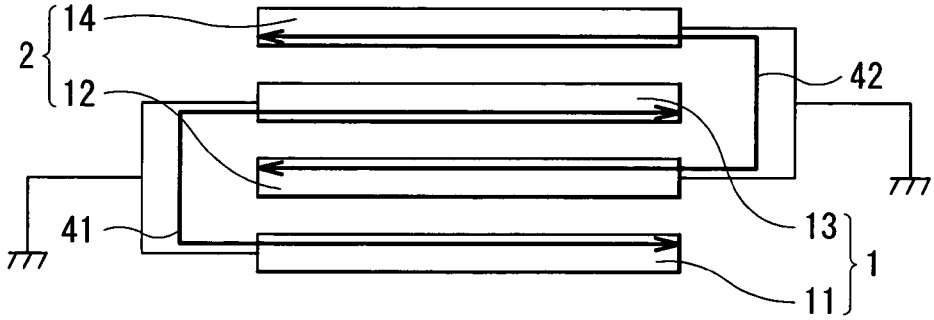
FIG. 19 is an explanatory drawing illustrating an unnecessary signal path suppressed by the stacked resonator in the second embodiment.

As described above with reference to FIG. 4 in the first embodiment, in the stacked resonator of the second embodiment, a current i flows in the same direction to the conductor lines 11, 12, 13, and 14 in the second resonance mode of a low frequency. That is, the current i flows as illustrate in FIG. 18. Here, assuming that the short-circuit ends of the conductor lines 11 and 13 in the first conductor group 1 are connected to the same ground layer in the stacked resonator, there can be generated a current path 41 passing through between the conductor lines 11 and 13, with the ground layer interposed therebetween, as illustrated in FIG. 19. Similarly, a current path 42 can be generated in the conductor lines 12 and 14 of the second conductor group 2.

Figure 20:
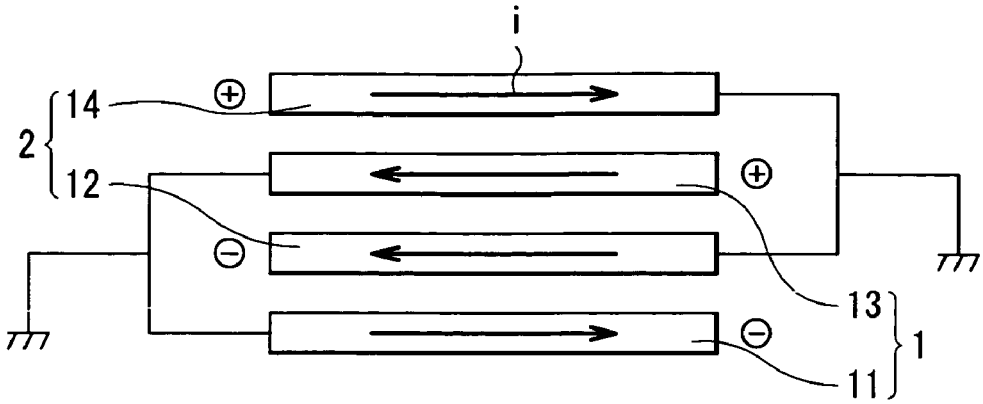
FIG. 20 is an explanatory drawing illustrating an example of a current distribution in a resonance mode on a high frequency side suppressed by the stacked resonator of the second embodiment.
Figure 21:
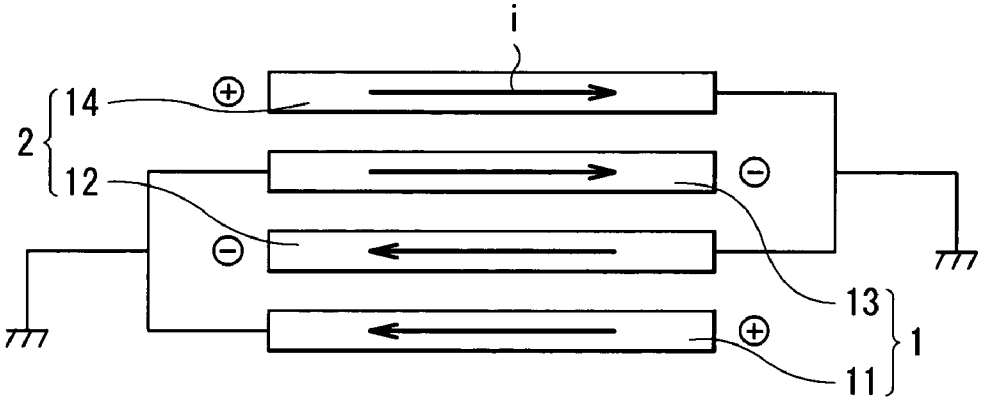
FIG. 21 is an explanatory drawing illustrating another example of the current distribution in the resonance mode on the high frequency side suppressed by the stacked resonator in the second embodiment.
Figure 22:
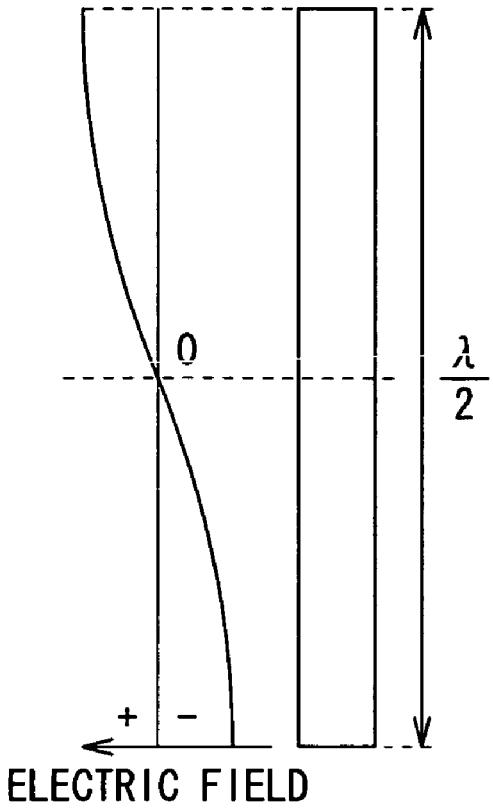
FIG. 22 is an explanatory drawing illustrating an equivalent line structure in the resonance mode on the high frequency side suppressed by the stacked resonator of the second embodiment.
Figure 23:
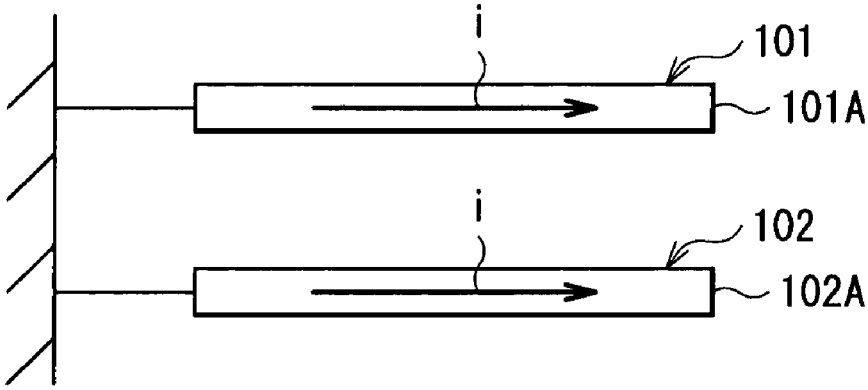
FIG. 23 RELATED ART
FIG. 23 is a diagram illustrating schematically the structure of a comb-line coupled resonators.
Figure 24A:
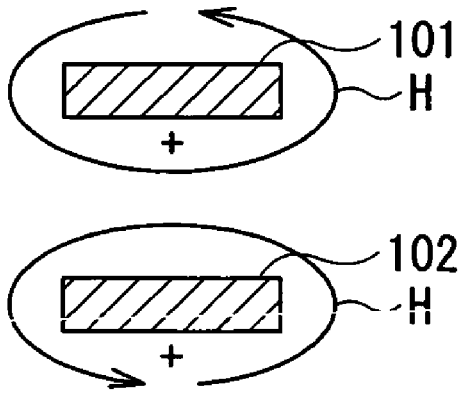
FIGS. 24A and 24B are first and second explanatory drawings illustrating magnetic field distributions in two comb-line coupled resonators, respectively.
Figure 24B:
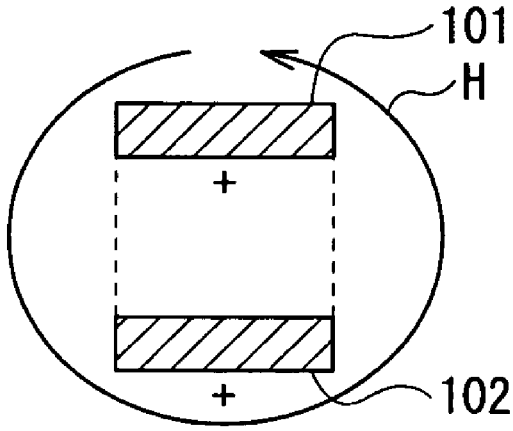

Assuming, for example, that the conductor lines 11, 12, 13, and 14 are quarter-wave resonators, the generation of the above-mentioned current paths produces equivalently a half-wave resonator (see FIG. 22), both ends of which become open ends. That is, the conductor lines 11 and 13 of the first conductor group 1 form a resonator opened on both ends, and the conductor lines 12 and 14 of the second conductor group 2 form a resonator opened on both ends. In this case, the current i does not flow in the same direction to the conductor lines 11, 12, 13, and 14. Specifically, there can be generated, for example, a resonance mode of providing a current distribution in which current flows in opposite directions in the first and second conductor groups 1 and 2, as illustrated in FIGS. 20 and 21. This resonance mode is a higher resonance mode having a higher frequency than the second resonance mode, and it might deteriorate the characteristic as a resonator. The second embodiment can suppress the above-mentioned higher resonance mode by virtue of the configuration that the conductor lines in the first and second conductor groups 1 and 2 are in conduction to each other at the positions other than the short-circuit ends, respectively. Since the above-mentioned higher resonance mode can be caused by the current paths formed through the short-circuit end side, the higher resonance mode can be suppressed more satisfactorily as the position where the conductor lines are in conduction to each other is closer to the open end side.

Thus, the second embodiment is capable of suppressing any unnecessary resonance mode due to interdigital-coupling, by the configuration that the conductor lines in the first and second conductor groups 1 and 2 are in conduction to each other at the positions other than the short-circuit ends, respectively.

It should be understood by those skilled in the art that various modifications, combinations, sub-combinations and alterations may occur depending on design requirements and other factors insofar as they are within the scope of the appended claims or the equivalents thereof.

What is claimed is:

1. A stacked resonator comprising:

a first conductor group having a plurality of conductor lines in a stacking arrangement, one end of each of the plurality of conductor lines being configured as a short-circuit end, and the other end thereof being configured as an open end; and a second conductor group having a plurality of other conductor lines in a stacking arrangement so as to be alternately provided opposing to the plurality of conductor lines in the first conductor group, such that one end of each of the plurality of conductor lines in the second conductor group is opposed to the open ends of the plurality of conductor lines in the first conductor group and is configured as a short-circuit end and the other end of each of the plurality of other conductor lines in the second conductor group is opposed to the short-circuit ends of the plurality of conductor lines in the first conductor group and is configured as an open end, thereby establishing an interdigital-coupling together with the first conductor group, wherein the plurality of conductor lines in the first conductor group are electrically in direct conduction to each other by a conductor at positions other than the short-circuit ends of the plurality of conductor lines in the first conductor group;

the plurality of other conductor lines in the second conductor group are electrically in direct conduction to each other by a conductor at positions other than the short-circuit ends of the plurality of other conductor lines in the second conductor group;

the first conductor group is regarded in whole as one resonator, the second group is regarded in whole as another resonator, and as a whole a pair of mutually interdigital-coupled resonators is formed;

with respect to a resonance frequency $f_0$ in each of the one and another resonators when establishing no interdigital-coupling, the pair of resonators have a first resonance mode that resonates at a first resonance frequency $f_1$ higher than the resonance frequency $f_0$, and a second resonance mode resonates at a second resonance frequency $f_2$ lower than the resonance frequency $f_0$, and an operating frequency is set as the second resonance frequency $f_2$; and the pair of interdigital-coupled resonators is mutually excited in reversed-phase by the second resonance mode.

2. The stacked resonator according to claim 1, comprising:

a first connecting terminal used to bring the plurality of conductor lines in the first conductor group into conduction to each other; and a second connecting terminal used to bring the plurality of other conductor lines in the second conductor group into conduction to each other.

3. The stacked resonator according to claim 1, wherein the positions where the plurality of conductor lines in the first conductor group are in conduction to each other are located between the central positions of the conductor lines exclusive and the open ends inclusive; and the positions where the plurality of other conductor lines in the second conductor group are in conduction to each other are located between the central positions of the plurality of other conductor lines exclusive and the open ends inclusive.

4. The stacked resonator according to claim 1, comprising:

a first through-hole bringing the plurality of conductor lines in the first conductor group into conduction to each other; and a second through-hole bringing the plurality of other conductor lines in the second conductor group into conduction to each other.

5. A stacked resonator comprising:

a first conductor group having a plurality of conductor lines in a stacking arrangement, one end of each of the plurality of conductor lines being configured as a short-circuit end, and the other end thereof being configured as an open end; and a second conductor group having a plurality of other conductor lines in a stacking arrangement so as to be alternately provided opposing to the plurality of conductor lines in the first conductor group, such that one end of each of the plurality of other conductor lines in the second conductor group is opposed to the open ends of the plurality of conductor lines in the first conductor group and is configured as a short-circuit end and the other end of each of the plurality of other conductor lines in the second conductor group is opposed to the short-circuit ends of the plurality of conductor lines in the first conductor group and is configured as an open end, thereby establishing an interdigital-coupling together with the first conductor group, wherein the plurality of conductor lines in the first conductor group are electrically in direct conduction to each other by a conductor at positions other than the short-circuit ends of the plurality of conductor lines in the first conductor group;

the conductor lines in the second conductor group are electrically in direct conduction to each other by a conductor at positions other than the short-circuit ends of the conductor lines in the second conductor group; and the interdigital-coupling establishes two resonance modes including a first resonance mode that resonates at a first resonance frequency $f_1$ and a second resonance mode that resonates at a second resonance frequency $f_2$; the first resonance frequency is higher than an original resonance frequency $f_0$ of a resonator consisting of only the first conductor group without being interdigital-coupled to the second conductor group; and the second resonance frequency $f_2$ is lower than the first resonance frequency $f_1$.

6. The stacked resonator according to claim 5, wherein the interdigital-coupling excites an electromagnetic wave in reversed-phase between the two resonance modes.

7. The stacked resonator according to claim 5, wherein the second resonance frequency $f_2$ is lower than the original resonance frequency $f_0$.

* * * * *